US006116699A

United States Patent [19]

Kaczmarski et al.

[11] Patent Number: 6,116,699

[45] Date of Patent: Sep. 12, 2000

[54] PLANER WITH EDGE PLANING CAPABILITY

[75] Inventors: Wally L. Kaczmarski, Lisbon; Philip D. Bogner; Juel M. Bautz, both of Bismarck, all of N. Dak.

[73] Assignee: Clark Equipment Company, Woodcliff, N.J.

[21] Appl. No.: 09/124,475

[22] Filed: Jul. 29, 1998

[51] Int. Cl.[7] ..... E01C 23/088

[52] U.S. Cl. ..... 299/39.5; 299/39.1; 299/36.1

[58] Field of Search ..... 299/36.1, 39.1, 299/39.4, 39.5, 39.6; 404/90; 15/82; 464/170, 176; 74/608, 609

[56] References Cited

U.S. PATENT DOCUMENTS

| | | | |
|---|---|---|---|
| 452,382 | 5/1891 | Morgan | 15/82 |
| 3,001,303 | 9/1961 | Frederick | 37/94 |
| 3,156,231 | 11/1964 | Harding, Jr. | 125/5 |
| 3,895,843 | 7/1975 | Wall et al. | 299/39.1 |
| 4,103,973 | 8/1978 | Cutler | 299/39.1 |
| 4,162,102 | 7/1979 | Rooymans | 299/10 |
| 4,332,422 | 6/1982 | Hilshort | 299/39 |
| 4,704,045 | 11/1987 | Taylor et al. | 404/90 |
| 4,720,207 | 1/1988 | Salani | 404/90 |
| 4,755,001 | 7/1988 | Gilbert | 299/39 |
| 4,878,713 | 11/1989 | Zanetis | 299/39 |
| 4,946,307 | 8/1990 | Jakob | 404/90 |
| 5,124,287 | 6/1992 | Karnes | 299/39 |
| 5,129,755 | 7/1992 | Dickson | 404/90 |
| 5,236,278 | 8/1993 | Dickson | 404/90 |
| 5,354,146 | 10/1994 | O'Konek | 404/90 |
| 5,378,080 | 1/1995 | Dickson | 404/90 |
| 5,382,084 | 1/1995 | Diver et al. | 299/39 |

FOREIGN PATENT DOCUMENTS

| | | |
|---|---|---|
| 0 735 192 A2 | 3/1996 | European Pat. Off. . |
| 99 11 4775 | 11/1999 | European Pat. Off. . |
| 25 40 047 A1 | 9/1975 | Germany . |
| 28 16 176 A1 | 4/1978 | Germany . |
| 28 35 270 A1 | 8/1978 | Germany . |
| 88 12 328 U1 | 9/1988 | Germany . |
| 41 23 777 A1 | 1/1993 | Germany . |

OTHER PUBLICATIONS

"Planar Attachments", brochure, Melroe Ingersoll–Rand, Jan. 1997.

Web page: "http://www.bobcat.com/worksaver/97s/ws_97s_planer_intro_02.html" Apr. 2000.

Melroe Publication "Worksaver" Spring 1997 issue; pp. 1–5.

*Primary Examiner*—Eileen D. Lillis
*Assistant Examiner*—John Kreck
*Attorney, Agent, or Firm*—Joseph R. Kelly; Westman, Champlin & Kelly, P.A.

[57] ABSTRACT

An attachment for a power machine includes a first mounting plate and a housing mounted to the mounting plate. The housing has a front end and a rear end and generally oppositely disposed first and second sides. The first side of the housing is removable. A rotor is rotatably mounted to the second side of the housing and has a surface and first and second longitudinal ends. A portion of the surface and the first longitudinal end are exposed by removal of the first side of the housing. A motor is coupled to the rotor to rotatably drive the rotor.

22 Claims, 7 Drawing Sheets

PLANER WITH EDGE PLANING CAPABILITY

BACKGROUND OF THE INVENTION

The present invention deals with power machines. More specifically, the present invention deals with a rotatable, and laterally movable machine attachment to a power machine, such as a skid steer loader.

Power machines, such as skid steer loaders, typically have a frame which supports a cab or operator compartment and a movable lift arm which, in turn, supports a work tool such as a planer. The movable lift arm is pivotally coupled to the frame of the skid steer loader and is powered by power actuators which are commonly hydraulic cylinders. In addition, the tool is coupled to the lift arm and is powered by one or more additional power actuators which are also commonly hydraulic cylinders. An operator manipulating a skid steer loader raises and lowers the lift arm and manipulates the tool, by actuating the hydraulic cylinders coupled to the lift arm, and the hydraulic cylinder coupled to the tool. Manipulation of the lift arm and tool is typically accomplished through manual operation of foot pedals or hand controls which are attached by mechanical linkages to valves (or valve spools) which control operation of the hydraulic cylinders.

Skid steer loaders also commonly have an engine which drives a hydraulic pump. The hydraulic pump powers hydraulic traction motors which provide powered movement of the skid steer loader. The traction motors are commonly coupled to the wheels through a drive mechanism such as a chain drive. A pair of steering levers are typically provided in the operator compartment which are movable fore and aft to control the traction motors driving the sets of wheels on either side of the skid steer loader. By manipulating the steering levers, the operator can steer the skid steer loader and control the loader in forward and backward directions of travel.

Conventional planers are mounted to the front of a skid steer loader and have a rotatable drum with a plurality of projecting teeth, projecting from the rotatable drum. The rotatable drum is conventionally mounted within a housing that also supports a motor for driving rotation of the rotatable drum. In addition, the planer is conventionally mounted to an attachment bracket which supports a plurality of slide rails. The planer is attached to the slide rails and can be driven for lateral movement along the slide rails. This allows the planer to be moved back and forth in a direction transverse to the direction of travel of the skid steer loader.

Such planers are typically used to remove a layer of material from a surface over which the skid steer loader is traveling. For instance, such planers are commonly used to remove a layer of asphalt from a road. As the skid steer loader is moved in the forward direction, the planer is activated such that the rotatable drum rotates at a high speed to remove the asphalt layer. In addition, the planer is slowly moved back and forth in a direction transverse to the direction of travel of the skid steer loader, such that a desired width of the asphalt is removed.

Such planers are commonly used on roadways which include a curb. However, due to the housing which conventionally houses the rotatable drum, planers have not been positionable closely adjacent the curb to plane the asphalt layer up to the edge of the curb. This leaves an edge portion of the asphalt layer along the curb which must removed by hand, such as with manual operation of jackhammers. Such manual removal renders the asphalt removal process much more expensive and cumbersome than would otherwise be the case.

SUMMARY OF THE INVENTION

An attachment for a power machine includes a first mounting plate and a housing mounted to the mounting plate. The housing has a front end and a rear end and generally oppositely disposed first and second sides. The first side of the housing is removable. A rotor is rotatably mounted to the second side of the housing and has a surface and first and second longitudinal ends. A portion of the surface and the first longitudinal end are exposed by removal of the first side of the housing. A motor is coupled to the rotor to rotatably drive the rotor.

DETAILED DESCRIPTION OF THE PREFERRED EMBODIMENTS

Overview

Figure 1:
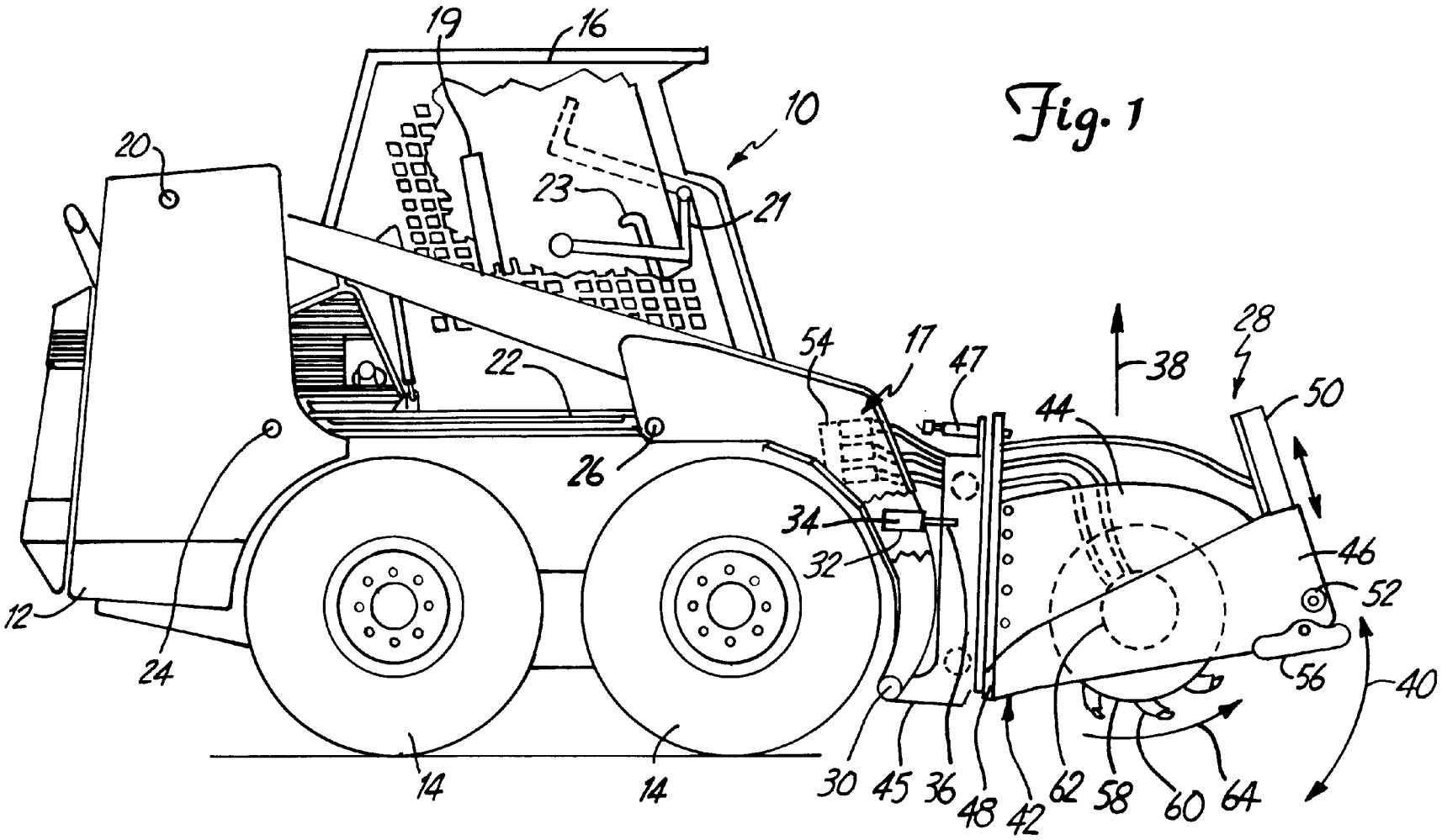
FIG. 1 is a side view of a skid steer loader with a planer mounted thereto in accordance with one aspect of the present invention.

FIG. 1 is a side elevational view of a skid steer loader 10 according to one aspect of the present invention. Skid steer loader 10 includes a frame 12 supported by wheels 14. Frame 12 also supports a cab 16 which defines an operator compartment and which substantially encloses a seat 19 on which an operator sits to control skid steer loader 10. A seat bar 21 is pivotally coupled to a portion of cab 16. When the operator occupies seat 19, the operator then pivots seat bar 21 from the raised position (shown in phantom in FIG. 1) to the lowered position shown in FIG. 1.

A pair of steering levers 23 (only one of which is shown in FIG. 1) are mounted within cab 16. Levers 23 are manipulated by the operator to control forward and rearward movement of skid steer loader 10, and in order to steer skid steer loader 10.

A lift arm 17 is coupled to frame 12 at pivot points 20 (only one of which is shown in FIG. 1, the other being identically disposed on the opposite side of loader 10). A pair of hydraulic cylinders 22 (only one of which is shown in FIG. 1) are pivotally coupled to frame 12 at pivot points 24 and to lift arm 17 at pivot points 26. Lift arm 17 is coupled to a working tool which, in this preferred embodiment, is a planer 28. Lift arm 17 is pivotally coupled to planer 28 at pivot points 30. In addition, another hydraulic cylinder 32 is pivotally coupled to lift arm 17 at pivot point 34 and to planer 28 at pivot point 36. While only one cylinder 32 is shown, it is to be understood that any desired number of cylinders can be used to work planer 28 or any other suitable tool.

The operator residing in cab 16 manipulates lift arm 17 and planer 28 by selectively actuating hydraulic cylinders 22 and 32. Such actuation may be accomplished by the manipulation of foot pedals in cab 16 or by actuation of hand grips in cab 16, both of which are attached by mechanical linkages to valves (or valve spools) which control operation of cylinders 22 and 32. In addition, the actuation can be accomplished by moving a movable element, such as a foot pedal or a hand grip on steering lever 23, and electronically controlling movement of cylinders 22 and 32 based on the movement of the movable element.

By actuating hydraulic cylinders 22 and causing hydraulic cylinders 22 to increase in length, the operator moves lift arm 17, and consequently planer 28, generally vertically upward in the direction indicated by arrow 38. Conversely, when the operator actuates cylinder 22 causing it to decrease in length, planer 28 moves generally vertically downward to the position shown in FIG. 1.

The operator can also manipulate planer 28 by actuating cylinder 32. This is also preferably done by pivoting a movable element (such as a foot pedal or a hand grip on one of levers 23) and electronically or mechanically controlling cylinder 32 based on the movement of the element. When the operator causes cylinder 32 to increase in length, planer 28 tilts forward about pivot points 30. Conversely, when the operator causes cylinder 32 to decrease in length, planer 28 tilts rearward about pivot points 30. The tilting is generally along an arcuate path indicated by arrow 40.

Figure 2:
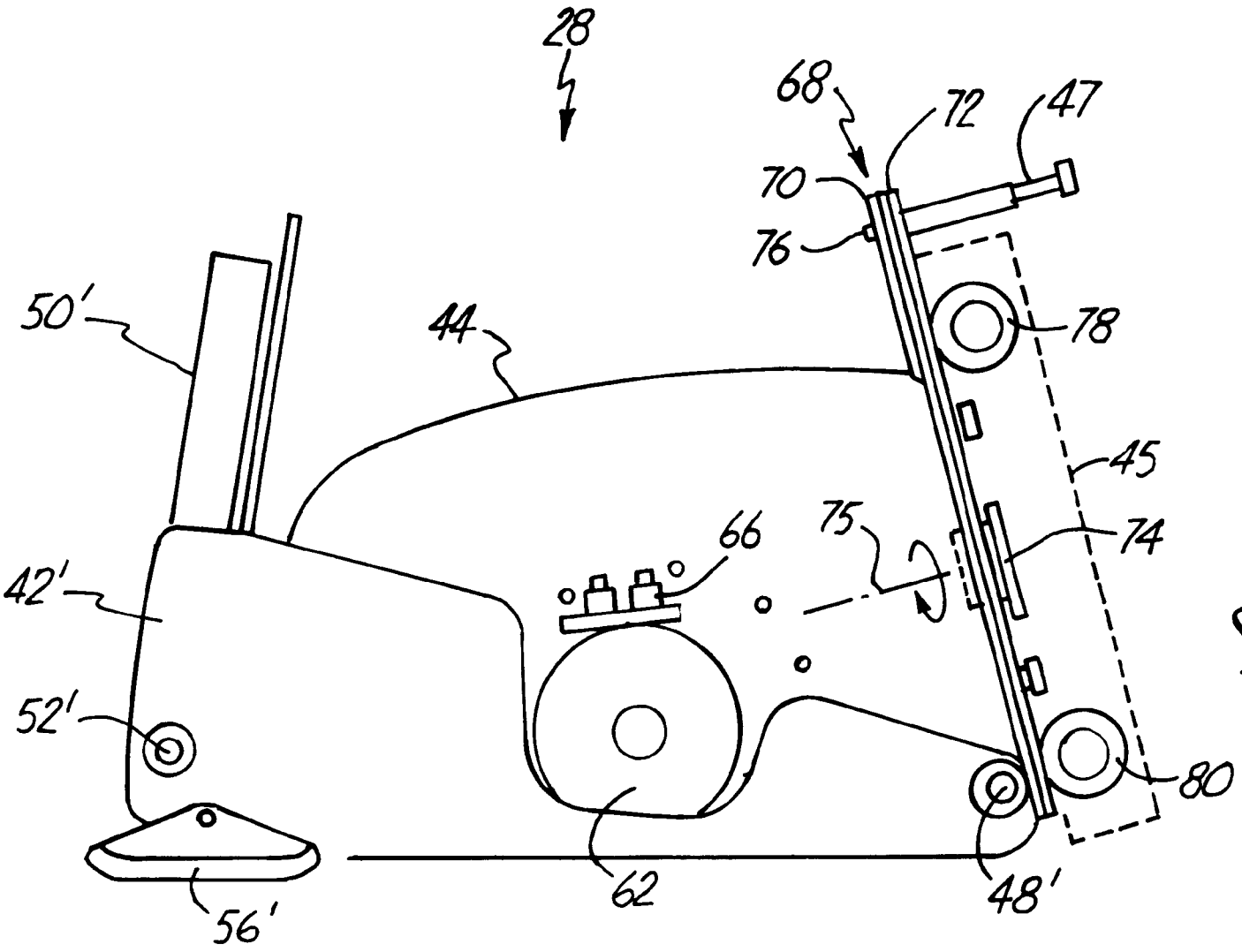
FIG. 2 is an opposite side view of the planer shown in FIG. 1.

Planer 28 includes a housing 46 which has an upper portion 44 and side plate 42. A second side plate 42' is located on an opposite side of planer 28 and is shown in FIG. 2. Side plates 42 and 42' are pivotable relative to upper portion 44 about pivot points 48 and 48'. As is described in greater detail later in the application, cylinders, such as cylinder 50 and 50', are mounted to upper portion 44 of housing 46 and to pivotable side plates 42 and 42' at pivot points 52 and 52'. Cylinders 50 and 50' receive hydraulic fluid from a valve stack 54 on loader 10. As cylinder 50 is caused to increase in length, pivotable plate 42 pivots downwardly relative to upper housing portion 44 about pivot point 48. This causes a ski 56 pivotably mounted to plate 42 to firmly engage the ground. As cylinder 50 is continuously lengthened, upper housing 44 is lifted up relative to side plate 42.

Planer 28 includes a rotatable drum 58 with a plurality of teeth 60 projecting therefrom. Rotatable drum 58 is driven for rotation by motor 62, which receives hydraulic fluid from hydraulic valve 54 on loader 10. As hydraulic fluid under pressure is supplied to motor 62, rotatable drum 58 is driven for rotation in the direction indicated by arrow 64. Thus, by adjusting the length by which cylinders 50 and 50' are extended, the depth of engagement of teeth 60 with the ground can be closely controlled.

Planer 28 is mounted to loader 10 by a mounting bracket 45 which is described in greater detail later in the application. In addition, planer housing 46 also includes a lock pin 47, which unlocks planer 28 for rotation relative to mounting bracket 45. This is also described in greater detail later in the application.

FIG. 2 is an opposite side view of planer 28 from that shown in FIG. 1. FIG. 2 better illustrates motor 62 which, in one preferred embodiment, is a hydraulic motor which receives hydraulic fluid from hoses coupled to hydraulic fluid couplings 66. FIG. 2 also illustrates cylinder 50' which is directly oppositely located to cylinder 50 (shown in FIG. 1), side plate 42' which is oppositely located to side plate 42, ski 56' which is oppositely located to ski 56 and pivot point 48' which is oppositely located to pivot point 48. Each of these items function similarly to the corresponding items described with respect to FIG. 1.

FIG. 2 also illustrates mounting mechanism 68 by which planer 28 is mounted to mounting bracket 45. Mounting mechanism 68, in one illustrative embodiment, includes a first mounting plate 70 and a second mounting plate 72. Mounting plate 70 is rigidly coupled to housing 44, and is rotatably coupled relative to mounting plate 72 by rotatable coupling mechanism 74. Rotatable coupling mechanism 74 can include any suitable rotatable coupling mechanism, such as an oil filled rotatable bearing. Since plate 70 is rotatable relative to plate 72, and is also rigidly attached to housing 44, a majority of planer 28, including housing 44, is rotatable relative to plate 72, and is thus rotatable relative to skid steer loader 10. This type of rotation is in a direction normal to the page of FIG. 2 about an axis of rotation 75.

Locking pin 47 is preferably a spring biased pin, which is biased in the position shown in FIG. 2. Locking pin 47 has an engagement end 76 which is preferably engageable with one of a plurality of apertures in mounting plate 70. Thus, planer 28 can be rotated to a desired position, and locked in that position, if desired.

FIG. 2 also illustrates that mounting plate 72 is rigidly attached to a pair of slide rail receiving members 78 and 80. Slide rail receiving members are preferably cylindrically shaped members which receive slide rails which extend along mounting bracket 45. As is described in greater detail later in the application, planer 28 is coupled to a motor (such as an electric motor or a liner hydraulic motor) which drives movement of planer 28 along the slide rails such that planer 28 can be moved in a direction transverse to the direction of movement of skid steer loader 10.

Figure 3:
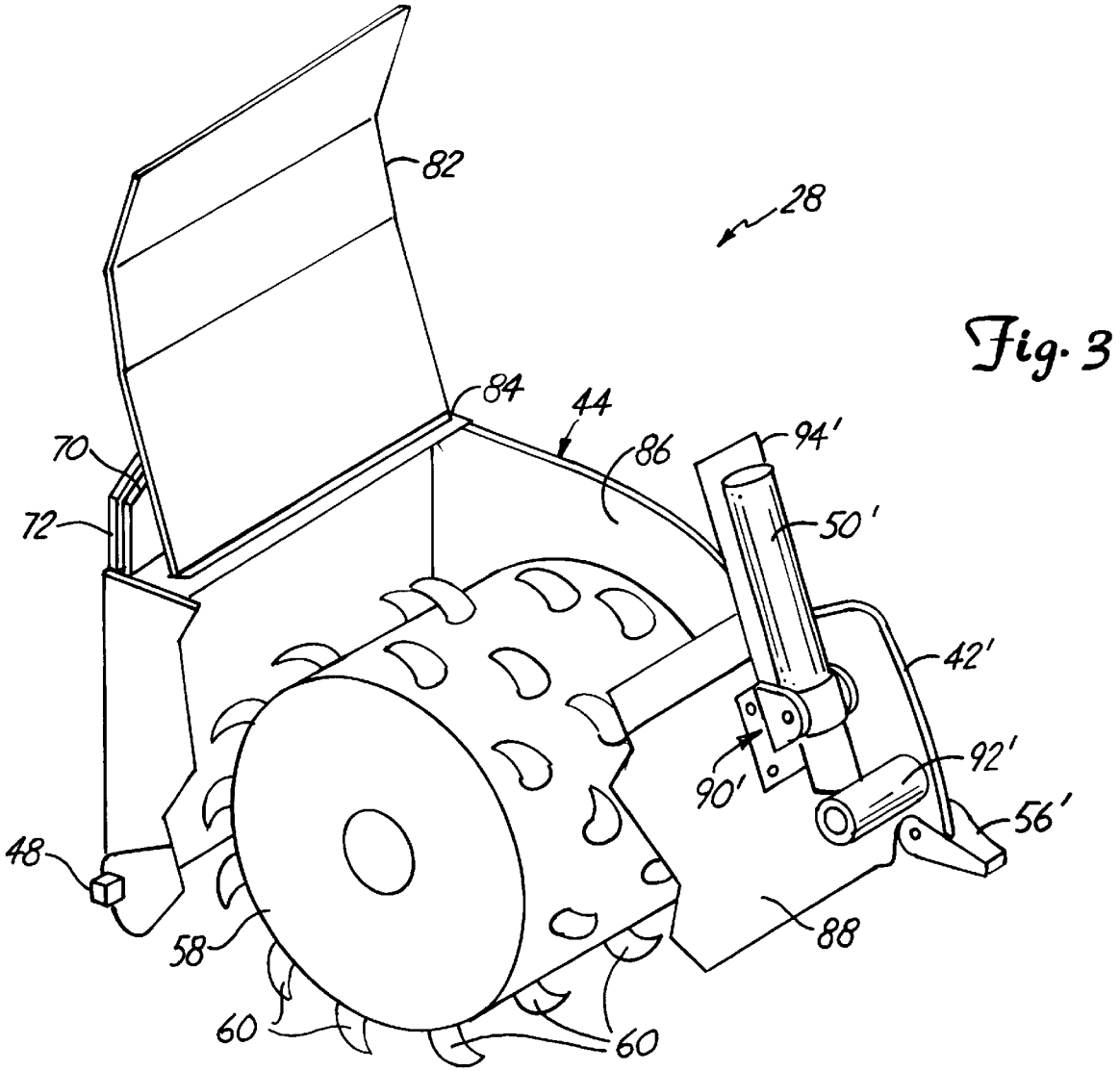
FIG. 3 is a perspective view of the planer shown in FIGS. 1 and 2, in partial sectional form.

FIG. 3 is an elevational view of planer 28, with a portion of housing 44 broken away. FIG. 3 illustrates that, in one preferred embodiment, planer 28 includes a cover 82 which is hingedly coupled to an upper portion of housing 44 along a hinged section 84. Thus, cover 82 can be lifted by an operator in order to gain access to rotating drum 58. FIG. 3 also illustrates that, in a preferred embodiment, rotatable drum 58 is mounted in a cantilevered fashion. In other words, drum 58 is rigidly attached to the drive shaft of motor 62 and is mounted for rotation relative to side wall 86 of housing 44, but is not mounted to the oppositely disposed sidewall.

FIG. 3 also better illustrates cylinder 50'. Cylinder 50' is preferably rigidly mounted to a front wall portion 88 of housing 44 by a mounting bracket 90'. Mounting bracket 90' can be any suitable mounting bracket arrangement. Cylinder 50' is also coupled to mounting pin 92' which is mounted to side plate 42'. Thus, as cylinder 50' is extended, pin 92' drives side plate 42' in the downward direction to raise the remainder of housing 44 relative to the surface against which ski 56' is engaged.

Figure 4:
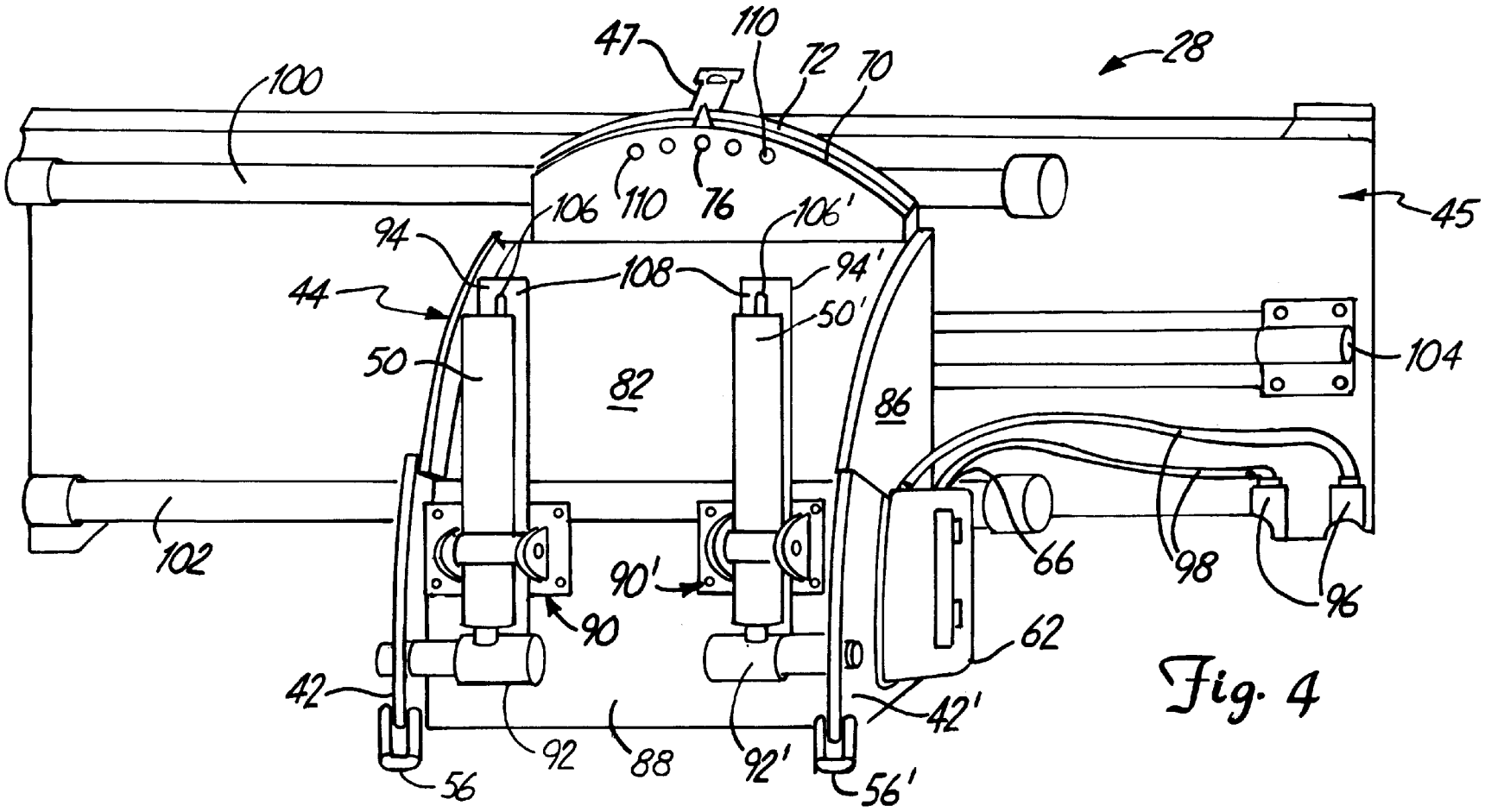
FIG. 4 is an elevational view of the planer shown in FIGS. 1–3 mounted to a mounting bracket.

FIG. 3 also illustrates that cylinder 50' has a corresponding depth indicator 94' which is described in greater detail with respect to FIG. 4.

FIG. 4 illustrates planer 28 coupled to mounting bracket 45. In one preferred embodiment, mounting bracket 45 has a plurality of hydraulic hose couplers 96. Hose couplers 96 are coupled to valve stack 66 by a plurality of hoses 98 in order to provide motor 62 with hydraulic fluid. Additional hoses (shown in FIG. 1) couple valve stack 66 to valve stack 54 on loader 10. Mounting bracket 45 also includes a plurality of slides 100 and 102. Slides 100 and 102 are preferably slidably disposed within cylindrical members 78 and 80 shown in FIG. 2. Thus, planer 28 is slidably disposed on mounting bracket 45.

FIG. 4 also illustrates that mounting bracket 45 preferably includes a side shift motor 104 mounted thereon. Side shift motor 104 can be an electric ball screw-type motor, or other electric motor, or a hydraulic motor, or a linear hydraulic actuator. In any case, motor 104 is coupled to plate 72 by a suitable coupling mechanism such that actuation of motor 104 in a first direction causes planer 28 to move along slides 100 and 102 in a first direction, and such that reverse actuation of motor 104 causes planer 28 to move along slides 100 and 102 in the opposite direction. Motor 104 is also preferably provided with power by a suitable power attachment (such as hydraulic hoses or an electrical harness) to loader 10.

In a preferred embodiment, where motor 104 is a hydraulic motor, it is coupled to receive hydraulic fluid from valve stack 66. Valve stack 66 preferably includes controllable, flow limiting, valves which limit the flow through the valves to that needed by the implements attached thereto. In a preferred control process, all hydraulic flow provided through valve stack 66 is provided to motor 62 during drum rotation. Only when motor 104 is to be actuated is any flow diverted from motor 62. Then, since the flow is restricted, only the flow necessary to drive planer 28 in the transverse direction along rails 100 and 102 (in order to accomplish a side shift) is diverted and the remainder is still provided to motor 62 for rotation of drum 58.

FIG. 4 also illustrates that depth indicators 94 and 94' are preferably plates rigidly mounted to cylinder rod ends 93 and 93'. Plates 94 and 94' have slits 106 and 106' running in a vertical direction therein. Further, cylinders 50 and 50' have indicia 108 which faces the operator of loader 10, and which is shown in phantom in FIG. 4. Indicia 108 preferably corresponds to depth markings, such as scribed lines or letters or other indicia which indicates how deeply planer 28 is planing on the surface over which skid steer loader 10 is moving.

Thus, in one illustrative embodiment, depth indicators 94 and 94' are rigidly attached to mounting pins 93 and 93', and move relative to housing 44 (and are thus movable relative to the front portion 88 of housing 44). As the operator actuates cylinders 50 and 50' to lengthen the cylinders, the tops of rod ends 93 and 93' extend away from the base portion of cylinders 50 and 50'. Thus, the tops of both indicators 94 and 94' move downwardly relative to cylinders 50 and 50'. The indicia 108 along cylinders 50 and 50' give the operator an indication as to the depth of engagement of planer 28 with the ground. This relative movement between depth indicators 94 and 94' and cylinders 50 and 50' thus provide the operator with an easy depth monitoring mechanism.

FIG. 4 also better illustrates the operation of pin 47. Plates 70 and 72 preferably have a number of normally aligned apertures 110, which extend along the upper end of plates 70. When pin 47 is withdrawn rearwardly, such that it does not engage the apertures 110 in plate 70, plate 70 (and thus the remainder of planer 28) can be rotated relative to plate 72. Pin 47 can then be allowed to "snap" back into place in one of apertures 110 under the influence of a bias spring (not shown).

Figure 5:
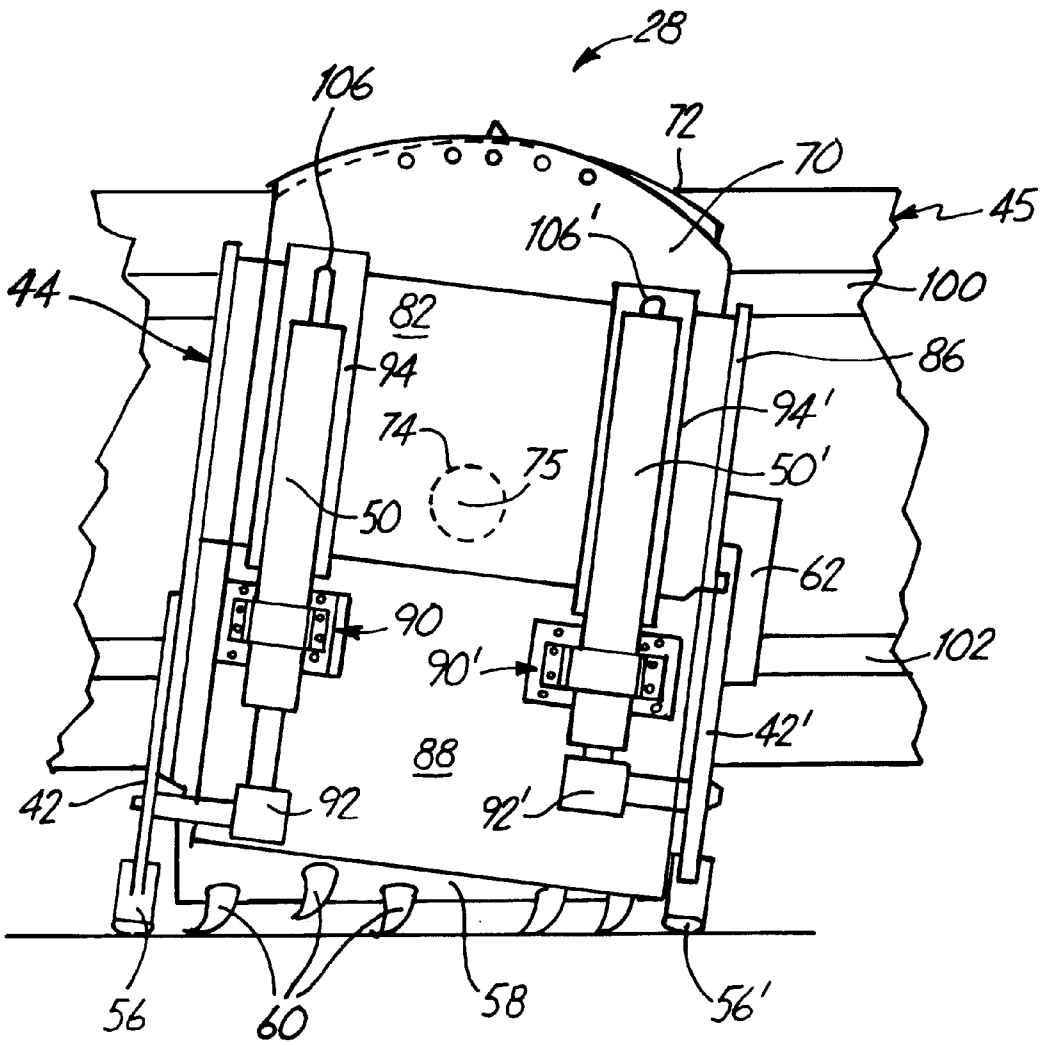
FIG. 5 illustrates the planer of FIGS. 1–4 in a slightly rotated position.

FIG. 5 illustrates planer 28 in a position slightly rotated relative to that shown in FIG. 4. In FIG. 5, cylinder 50 has been actuated by the operator in order to extend and lengthen somewhat relative to its position shown in FIG. 4. This causes pin 92 to drive side plate 42 downwardly relative to housing 44, causing the end of planer 28 on which cylinder 50 is disposed to lift off the ground relative to the opposite end. FIG. 5 also illustrates that mounting plate 70 is thus rotated slightly relative to mounting plate 72. This allows planing on uneven surfaces, or planing at an angle. Of course, it should also be noted that the operator can actuate both cylinders 50 and 50' equally. This simply causes planer 28 to plane on a level surface, but at a varying depth, depending upon the degree to which actuators 50 and 50' are extended.

Figure 6B:
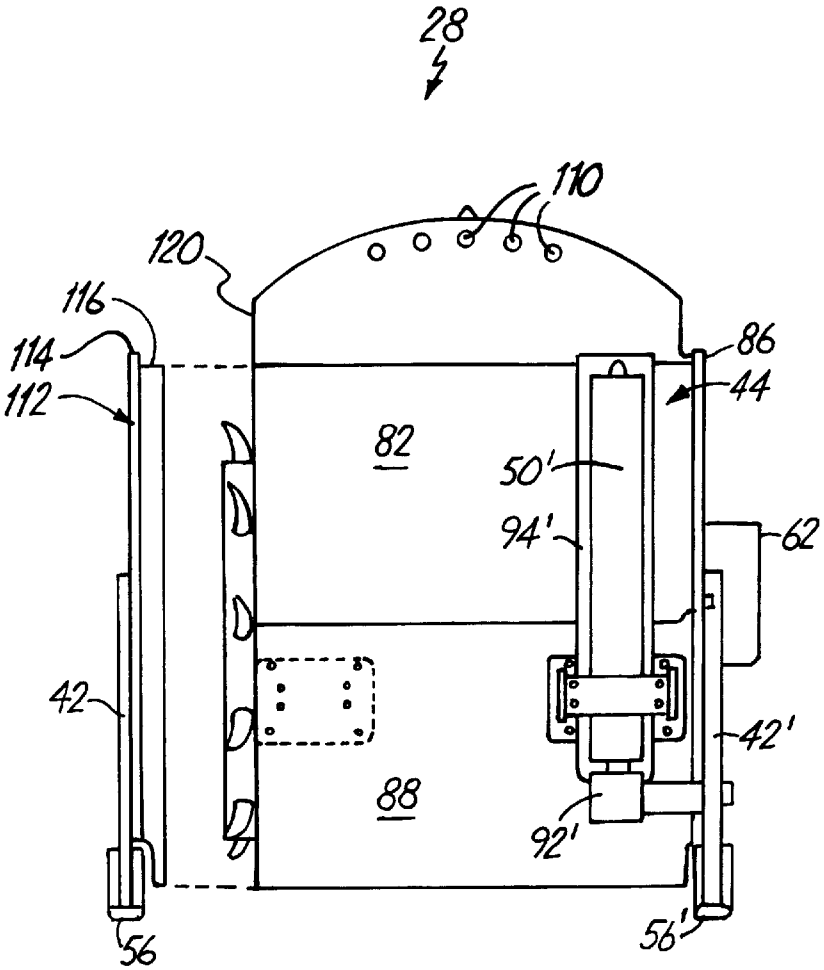
FIGS. 6A and 6B illustrate the planer illustrated in FIGS. 1–5 showing an end plate thereof removed.
Figure 6A:
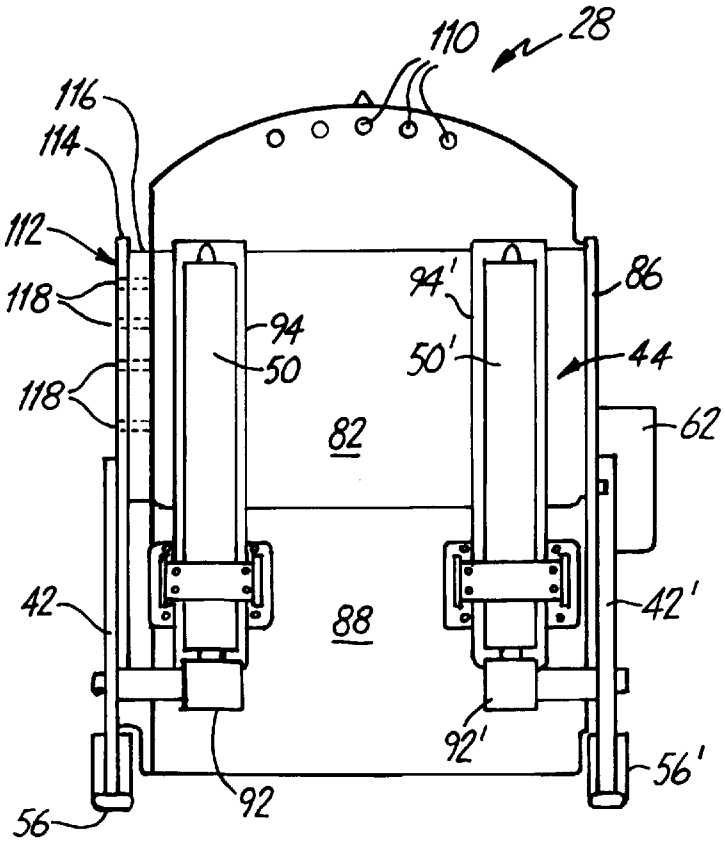

FIGS. 6A and 6B illustrate another feature of planer 28 in accordance with one aspect of the present invention. FIG. 6A is a front view of planer 28 which illustrates that side wall 112 (which forms a side of housing 44 opposite side 86) is formed of a plate portion 114 and a flange portion 116. Plate portion 114 and flange portion 116 are rigidly coupled to one another, such as through welding, etc. Flange 116 provides a spacing mechanism by which plate 112 which forms the wall of housing 44 is spaced from the remainder of housing 44. In a preferred embodiment, plate end 112 is coupled to the reminder of housing 44 by connection devices, such as screws, or bolts, inserted through a plurality of apertures 118 in plate 114 and flange 116.

FIG. 6B illustrates another preferred feature of planer 28. In FIG. 6B, side wall 112 of planer 28 has been removed from the remainder of housing 44. FIG. 6B also illustrates that cylinder 50, depth indicator 94 and rod end 93, and pin 92 have also been removed from housing 44. By contrast, it should be noted that cylinder 50 and rod end 93 could alternately remain on housing 98, simply by removing the portion of pin 92 which is coupled to plate 42. The rest of end plate 112 is removed by simply removing the connectors inserted through apertures 118.

In any case, once end wall 112 is removed from housing 44, a portion of drum 58 and teeth 60 project outwardly, in a lateral direction, from the interior of housing 44.

FIG. 6B also illustrates another preferred feature of the present invention. Drum 58 preferably extends in a sideways direction beyond the side 120 of end plates 70 and 72. Thus, with side wall 112 removed, the end of drum 58 projects beyond any portion of the housing or plates 70 and 72 of planer 28 or frame 45. This allows planer 28 to plane flush with an edge, such as a curb, or vertical wall against which planing is desired.

Figure 7:
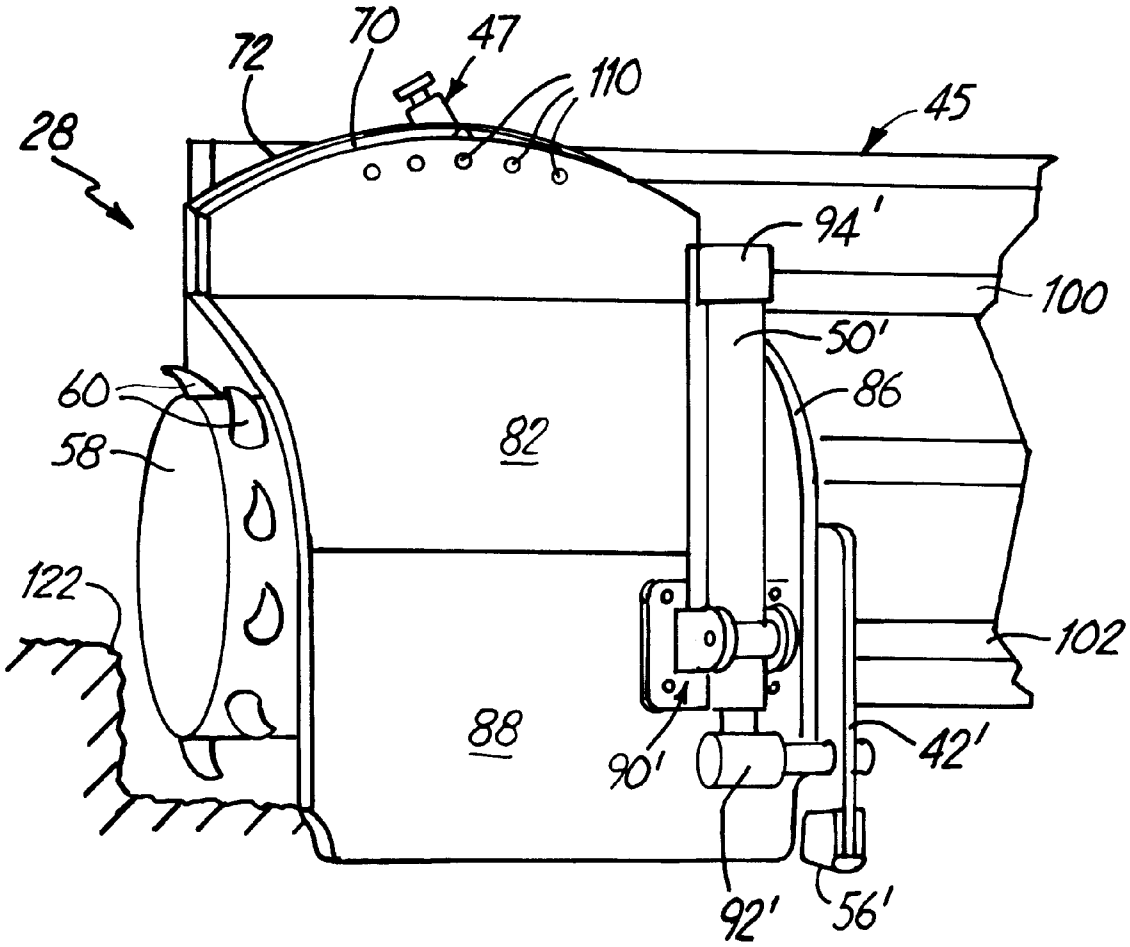
FIG. 7 is an elevational view of the planer shown in FIGS. 1–6, with the end plate removed, and planing along an edge of a curb.

FIG. 7 illustrates such planing. In FIG. 7, end plate 112, and cylinder 50 (for clarity of illustration), have been removed from planer 28. Planer 28 has also been advanced all the way to the right hand side (when viewed by the operator in cab 16) of mounting bracket 45, using motor 104 (shown in FIG. 4). Since the end of drum 58 extends beyond the housing 44 of planer 28, the end of drum 58, and the end teeth 60 mounted to drum 58, project beyond any other portion of planer 28 or mounting bracket 45. Thus, the end of drum 58 can be disposed flush up against an edge, such as curb 122 and thus plane the surface over which loader 10 is travelling, flush up against curb 122. This substantially eliminates the need to manually remove any remaining unplaned surface from the edge of curb 122. Thus, the present invention provides greatly increased efficiency in the planing operation.

A number of other modifications can also be made to planer 28. For instance, skis 56 can be replaced by wheels. Also, the present invention can be used with other implements. For instance, stump grinders have a similar arrangement to planer 28 in that a drum or other rotatable mechanism is used to grind stumps, and is moved in the lateral direction as well. Thus, the present invention can be used with such a device. In addition, wheel saws are also of similar general construction, and can benefit from the present invention as well. Of course, the present invention contemplates having application to similar implements or attachments.

Although the present invention has been described with reference to preferred embodiments, workers skilled in the art will recognize that changes may be made in form and detail without departing from the spirit and scope of the invention.

What is claimed is:

1. An attachment for a power machine, the attachment comprising:

a first mounting plate;

a housing mounted to the mounting plate, the housing having a front end and a rear end and generally oppositely disposed first and second sides, the first side of the housing being removable;

a rotor rotatably mounted to the second side of the housing and having a surface and first and second longitudinal ends, a portion of the surface and the first longitudinal end being exposed by removal of the first side of the housing; and a motor coupled to the rotor to rotatably drive the rotor, the rotor being operational when the first side of the housing is removed.

2. The attachment of claim 1 wherein the first side of the housing comprises:

a plate having a flange coupled thereto, the flange spacing the plate from a remainder of the housing in a direction generally parallel to a longitudinal axis of the rotor.

3. The attachment of claim 1 wherein the first longitudinal end of the rotor extends beyond a remainder of the housing when the first side of the housing is removed.

4. The attachment of claim 3 wherein the first longitudinal end of the rotor extends beyond the first mounting plate.

5. The attachment of claim 1 and further comprising:

a second mounting plate coupleable to the power machine and rotatably coupled to the first mounting plate.

6. The attachment of claim 5 and further comprising:

a first pivotable element pivotally coupled to the first side of the housing;

a second pivotable element pivotally coupled to the second side of the housing;

an actuator mechanism coupled to the housing and the first and second pivotable elements to drive pivotable movement of the first and second pivotable elements relative to the housing, the pivotal movement causing variation in a depth of the rotor exposed beneath the housing.

7. The attachment of claim 6 and further comprising:

a depth indicator coupled to at least one actuator mechanism with indicia thereon indicating the depth of the rotor exposed beneath the housing.

8. The attachment of claim 7 wherein the actuator mechanism comprises:

a first actuator mounted on a front end of the housing longitudinally within the first and second ends of the housing and coupled to the first pivotable element; and a second actuator mounted on the front end of the housing longitudinally within the first and second ends of the housing and coupled to the second pivotable element.

9. The attachment of claim 5 and further comprising:

an attachment bracket wherein the housing is slidably mounted to the attachment bracket; and an actuator mounted to the attachment bracket and coupled to the housing to drive slidable movement of the housing relative to the attachment bracket.

10. The attachment of claim 6 wherein the first and second pivotable elements each include a ground engaging ski attached thereto.

11. The attachment of claim 1 wherein the surface has a plurality of teeth extending therefrom.

12. A skid steer loader, comprising:

a lift arm;

an attachment mounted to the lift arm, the attachment comprising:

a first mounting plate;

a housing mounted to the mounting plate, the housing having a front end and a rear end and generally oppositely disposed first and second sides, the first side of the housing being removable;

a rotor rotatably mounted to the second side of the housing and having a surface and first and second longitudinal ends, a portion of the surface and the first longitudinal end being exposed by removal of the first side of the housing; and a motor coupled to the rotor to rotatably drive the rotor, the rotor being operational when the first side of the housing is removed.

13. The skid steer loader of claim 12 wherein the first side of the housing comprises:

a plate having a flange coupled thereto, the flange spacing the plate from a remainder of the housing in a direction generally parallel to a longitudinal axis of the rotor.

14. The skid steer loader of claim 12 wherein the first longitudinal end of the rotor extends beyond a remainder of the housing when the first side of the housing is removed.

15. The skid steer loader of claim 14 wherein the first longitudinal end of the rotor extends beyond the first mounting plate.

16. The skid steer loader of claim 12 wherein the attachment further comprises:

a second mounting plate coupleable to the power machine and rotatably coupled to the first mounting plate.

17. The skid steer loader of claim 16 wherein the attachment further comprises:

a first pivotable element pivotally coupled to the first side of the housing;

a second pivotable element pivotally coupled to the second side of the housing;

an actuator mechanism coupled to the housing and the first and second pivotable elements to drive pivotable movement of the first and second pivotable elements relative to the housing, the pivotal movement causing variation in a depth of the rotor exposed beneath the housing.

18. The skid steer loader of claim 17 wherein the attachment further comprises:

a depth indicator coupled to the housing with indicia thereon indicating the depth of the rotor exposed beneath the housing.

19. The skid steer loader of claim 18 wherein the actuator mechanism comprises:

a first actuator mounted on a front end of the housing longitudinally within the first and second ends of the housing and coupled to the first pivotable element; and a second actuator mounted on the front end of the housing longitudinally within the first and second ends of the housing and coupled to the second pivotable element.

20. The skid steer loader of claim 16 wherein the attachment further comprises:

an attachment bracket wherein the housing is slidably mounted to the attachment bracket; and an actuator mounted to the attachment bracket and coupled to the housing to drive slidable movement of the housing relative to the attachment bracket.

21. The skid steer loader of claim 17 wherein the first and second pivotable elements each include a ground engaging ski attached thereto.

22. The skid steer loader of claim 12 wherein the surface has a plurality of teeth extending therefrom.

* * * * *